US011814087B2

(12) United States Patent
Konoike et al.

(10) Patent No.: US 11,814,087 B2
(45) Date of Patent: Nov. 14, 2023

(54) SUPPORT STRUCTURE OF RAILCAR BOGIE AND METHOD OF SUPPORTING RAILCAR BOGIE

(71) Applicant: KAWASAKI RAILCAR MANUFACTURING CO., LTD., Kobe (JP)

(72) Inventors: Fumikazu Konoike, Kakogawa (JP); Francois Olivier Uchida, Kobe (JP)

(73) Assignee: KAWASAKI RAILCAR MANUFACTURING CO., LTD., Kobe (JP)

( * ) Notice: Subject to any disclaimer, the term of this patent is extended or adjusted under 35 U.S.C. 154(b) by 500 days.

(21) Appl. No.: 17/048,367

(22) PCT Filed: Apr. 17, 2018

(86) PCT No.: PCT/JP2018/015837
§ 371 (c)(1),
(2) Date: Oct. 16, 2020

(87) PCT Pub. No.: WO2019/202653
PCT Pub. Date: Oct. 24, 2019

(65) Prior Publication Data
US 2021/0179151 A1 Jun. 17, 2021

(51) Int. Cl.
*B61F 5/32* (2006.01)
*B61F 5/30* (2006.01)
*B61F 5/52* (2006.01)

(52) U.S. Cl.
CPC ..... *B61F 5/305* (2013.01); *B61F 5/32* (2013.01); *B61F 5/52* (2013.01)

(58) Field of Classification Search
CPC .... B61F 5/305; B61F 5/32; B61F 5/52; B61F 5/325; B61F 5/302; B61F 5/30; B61F 5/26
See application file for complete search history.

(56) References Cited

U.S. PATENT DOCUMENTS 5,299,871 A * 4/1994 Hancock ..... F16C 9/02 384/429
8,297,199 B2 * 10/2012 Nishimura ..... F16F 1/38 105/218.1
9,592,840 B2 * 3/2017 Okumura ..... B61F 5/32
2011/0253004 A1 10/2011 Nishimura et al.
2015/0344046 A1 * 12/2015 Nishimura ..... B61F 5/305 105/199.1

FOREIGN PATENT DOCUMENTS

JP 2010-184684 A 8/2010
JP 2011-85149 A 4/2011

* cited by examiner

*Primary Examiner* — Mark T Le
(74) *Attorney, Agent, or Firm* — Oliff PLC

(57) ABSTRACT

A support structure of a railcar bogie and a method of supporting a railcar bogie each of which is capable of easily managing axial force acting on a fastener between a pressing member and a main body sandwiching a shaft body. In the support structure of the railcar bogie, the pressing member and the main body are fastened to each other such that a clearance is formed between the pressing member and the main body. The support structure is configured such that a car upper-lower direction end portion, located around a first recess of the main body, of the main body and a car upper-lower direction end portion of the pressing member are substantially flush with each other.

3 Claims, 5 Drawing Sheets

SUPPORT STRUCTURE OF RAILCAR BOGIE AND METHOD OF SUPPORTING RAILCAR BOGIE

TECHNICAL FIELD

The present invention relates to a support structure supporting a core rod in a railcar bogie and a method of supporting the core rod in the railcar bogie.

BACKGROUND ART

Conventionally used is a support structure configured to support a core rod to support a member connected to the core rod. One example of the support structure is disclosed in PTL 1. According to the support structure disclosed in PTL 1, in a bogie of a railcar, part of a core rod supporting an axle beam is fitted in a groove formed at a receiving seat of a bogie frame, and a pressing fixture is arranged under the groove so as to cover the groove. Then, the pressing fixture and the receiving seat are fastened to each other with bolts. Thus, the core rod is supported between the pressing fixture and the receiving seat. In PTL 1, two bolts are used so as to be lined up in a front-rear direction of the bogie, and the pressing fixture and the receiving seat are fastened to each other with these two bolts.

CITATION LIST

Patent Literature

PTL 1: Japanese Laid-Open Patent Application Publication No. 2010-184684

SUMMARY OF INVENTION

Technical Problem

In order to surely attach the pressing fixture to the receiving seat, equal axial forces need to act on the respective bolts. However, the axial force cannot be directly measured. Therefore, the application of equal fastening torques to the respective bolts and the horizontal attachment of the pressing fixture to the receiving seat without inclination are managed such that the equal axial forces act on the respective bolts. Specifically, the former is managed by fastening work using a torque wrench, and the latter is managed by using, for example, a method of confirming with a clearance gauge that a clearance between the pressing fixture and the receiving seat is uniform. However, there are problems that since a wheel rim portion and a brake equipment exist close to the pressing fixture located close to a wheel, performing confirmation work while directly seeing the pressing fixture is difficult, and working efficiency is low due to an inadequate space.

The present invention was made under the above circumstances, and an object of the present invention is to provide a support structure of a railcar bogie and a method of supporting the railcar bogie each of which is capable of easily managing proper attachment of a pressing member, sandwiching a core rod, to a receiving seat of a bogie frame.

Solution to Problem

A support structure of a railcar bogie includes: a receiving seat of a bogie frame, the receiving seat including a first recess and a second recess provided in the first recess; a core rod arranged in the second recess; a pressing member arranged in the first recess configured to press the core rod against the receiving seat; and a plurality of fasteners configured to fasten the pressing member to the receiving seat to sandwich the core rod by the pressing member and the receiving seat. The fasteners fasten the pressing member and the receiving seat such that a clearance is formed between the pressing member and the receiving seat. A car upper-lower direction end portion, located around the first recess, of the receiving seat and a car upper-lower direction end portion of the pressing member are flush with each other.

According to the support structure configured as above, the receiving seat and the pressing member are fastened to each other with the fasteners such that the car upper-lower direction end portion, located around the first recess, of the receiving seat and the car upper-lower direction end portion of the pressing member are the same in position in the car upper-lower direction as each other. Therefore, whether or not the pressing member is horizontally attached to the receiving seat without being inclined relative to the receiving seat can be easily confirmed by comparing the position of the car upper-lower direction end portion, located around the first recess, of the receiving seat with the position of the car upper-lower direction end portion of the pressing member.

A method of supporting a railcar bogie includes: arranging a core rod in a second recess of a receiving seat including a first recess and the second recess, the second recess being provided in the first recess; arranging a pressing member in the first recess; and fastening the pressing member to the receiving seat with a plurality of fasteners such that a clearance is formed between the pressing member and the receiving seat, to support the core rod between the receiving seat and the pressing member. The pressing member and the receiving seat are fastened to each other with the fasteners such that a car upper-lower direction end portion, located around the first recess, of the receiving seat and a car upper-lower direction end portion of the pressing member are flush with each other.

According to the above method of supporting the railcar bogie, the pressing member and the receiving seat are fastened to each other with the fasteners such that when the axial force acting on one of the fasteners sandwiching the core rod and the axial force acting on the other fastener are balanced, the car upper-lower direction end portion, located around the first recess, of the receiving seat and the car upper-lower direction end portion of the pressing member are flush with each other. Therefore, whether or not the pressing member is horizontally attached to the receiving seat without being inclined relative to the receiving seat can be easily confirmed by comparing the position of the car upper-lower direction end portion, located around the first recess, of the receiving seat with the position of the car upper-lower direction end portion of the pressing member.

Advantageous Effects of Invention

The present invention can provide a support structure of a railcar bogie and a method of supporting a railcar body each of which can easily manage proper attachment of a pressing member, sandwiching a core rod, to a receiving seat of a bogie frame.

DESCRIPTION OF EMBODIMENTS

Hereinafter, an embodiment regarding a support structure of a railcar bogie and a method of supporting the railcar bogie according to the present invention will be described with reference to the drawings. In the following description, a direction in which a railcar travels is defined as a car longitudinal direction, and a lateral direction perpendicular to the car longitudinal direction is defined as a car width direction. The car longitudinal direction is also referred to as a front-rear direction, and the car width direction is also referred to as a left-right direction.

Figure 1:
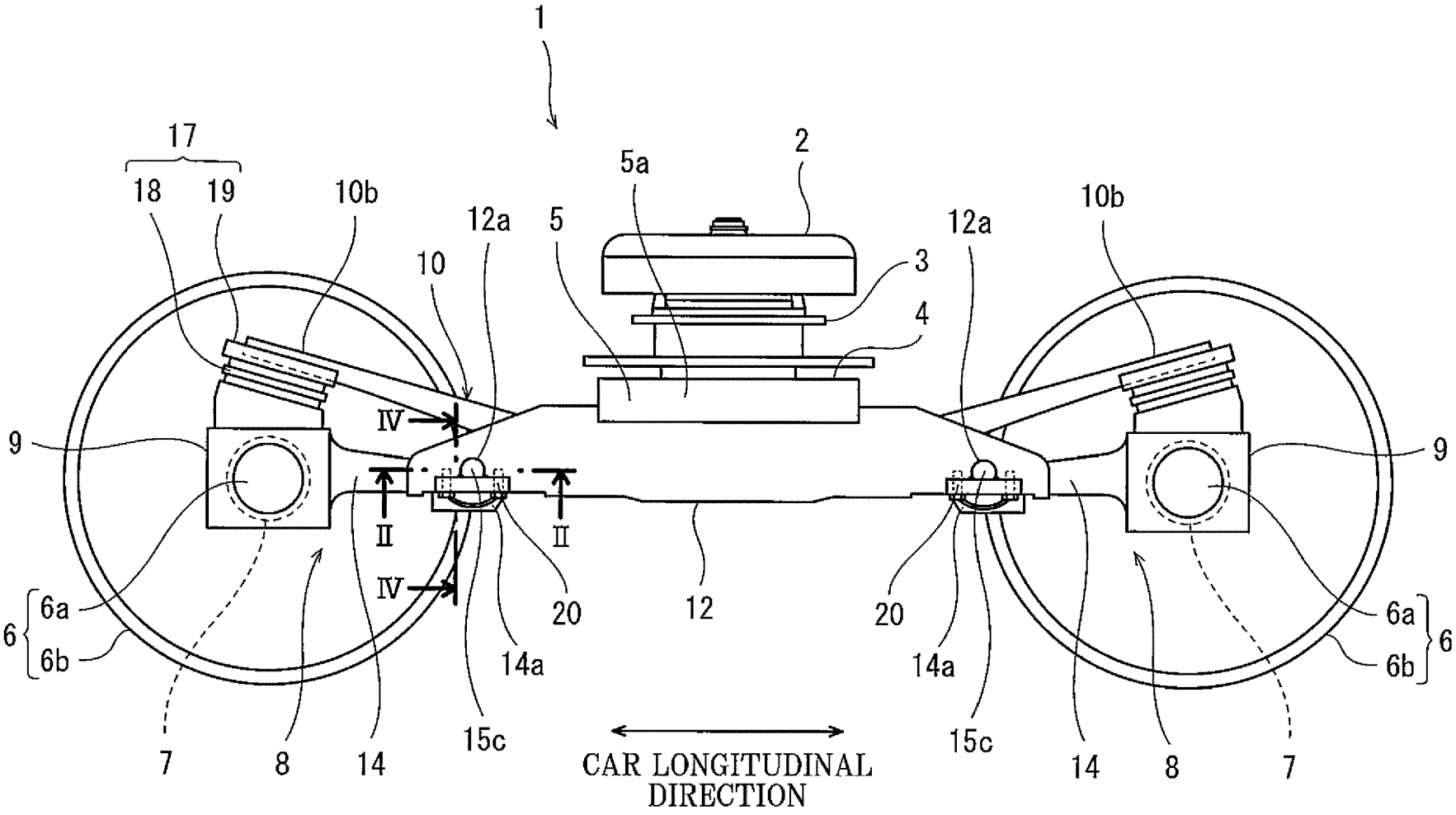
FIG. 1 is a side view of a railcar bogie according to an embodiment.

FIG. 1 is a side view a railcar bogie 1 according to the embodiment. As shown in FIG. 1, the railcar bogie 1 includes a bogie frame 4 supporting a car body through an air spring 2 (secondary suspension) and a bolster 3. The bogie frame 4 includes a cross beam 5 but does not include so-called side sills. The cross beam 5 extends in the car width direction and supports the car body (not shown).

The cross beam 5 is connected to the bolster 3 so as to be turnable relative to the bolster 3. The bolster 3 is connected to the car body through the air spring 2 and a bolster anchor (not shown). A pair of wheelsets 6 are arranged at both sides of the cross beam 5 in the car longitudinal direction. Each of the wheelsets 6 includes an axle 6*a* and wheels 6*b*. The axle 6*a* extends in the car width direction. The wheels 6*b* are provided at both sides of the axle 6*a* in the car width direction. Both car width direction side portions of the axle 6*a* are supported by bearings 7 such that the axle 6*a* is rotatable. The bearings 7 are accommodated in axle boxes 9 of axle box suspensions 8. The bogie 1 includes the axle box suspensions 8 at both end portions thereof in the car width direction. Therefore, the bogie 1 includes four axle box suspensions 8 that are two axle box suspensions 8 at the front side and two axle box suspensions 8 at the rear side.

The axle box suspensions 8 support end portions 10*b* of plate springs 10 each extending in the car longitudinal direction. Middle portions of the plate springs 10 support car width direction end portions 5*a* of the cross beam 5. To be specific, the plate spring 10 has both the function of a primary suspension and the function of a conventional side sill. The plate spring 10 is made of, for example, fiber-reinforced resin. In a side view, the plate spring 10 is formed in a bow shape that is convex downward as a whole. The plate spring 10 is formed in a circular-arc shape that is convex downward.

As shown in FIG. 1, the bogie frame 4 includes a pair of receiving seats 12 at each of both sides thereof in the car width direction. Each of the receiving seats 12 projects from the corresponding end portion 5*a* of the cross beam 5 downward and toward both sides in the car longitudinal direction. The plate spring 10 passes through a space between the pair of receiving seats 12 in the car longitudinal direction. The plate spring 10 is arranged so as to be spaced apart from the receiving seats 12 in the car width direction. In a side view, the middle portion of the plate spring 10 is arranged so as to overlap the receiving seat 12. A press-contact member (not shown) is placed on the middle portion of the plate spring 10 from above. The press-contact member is not fixed to the plate spring 10 and presses an upper surface of the plate spring 10 by a gravitational downward load from the cross beam 5 so as to be separable from the upper surface of the plate spring 10.

A spring seat 17 is attached to an upper portion of the axle box 9. The end portion 10*b* of the plate spring 10 extending in the car longitudinal direction is placed on the spring seat 17 from above so as to be separable from the spring seat 17 without being fixed to the spring seat 17. To be specific, both longitudinal direction end portions 10*b* of the plate spring 10 are supported by the axle boxes 9 through the spring seats 17. The spring seat 17 includes an elastic body 18 (multi-layer rubber, for example) and a receiving member 19. The elastic body 18 is positioned on an upper surface of the axle box 9. The receiving member 19 is positioned on the elastic body 18, and the end portion 10*b* of the plate spring 10 is placed on the receiving member 19.

Figure 2:
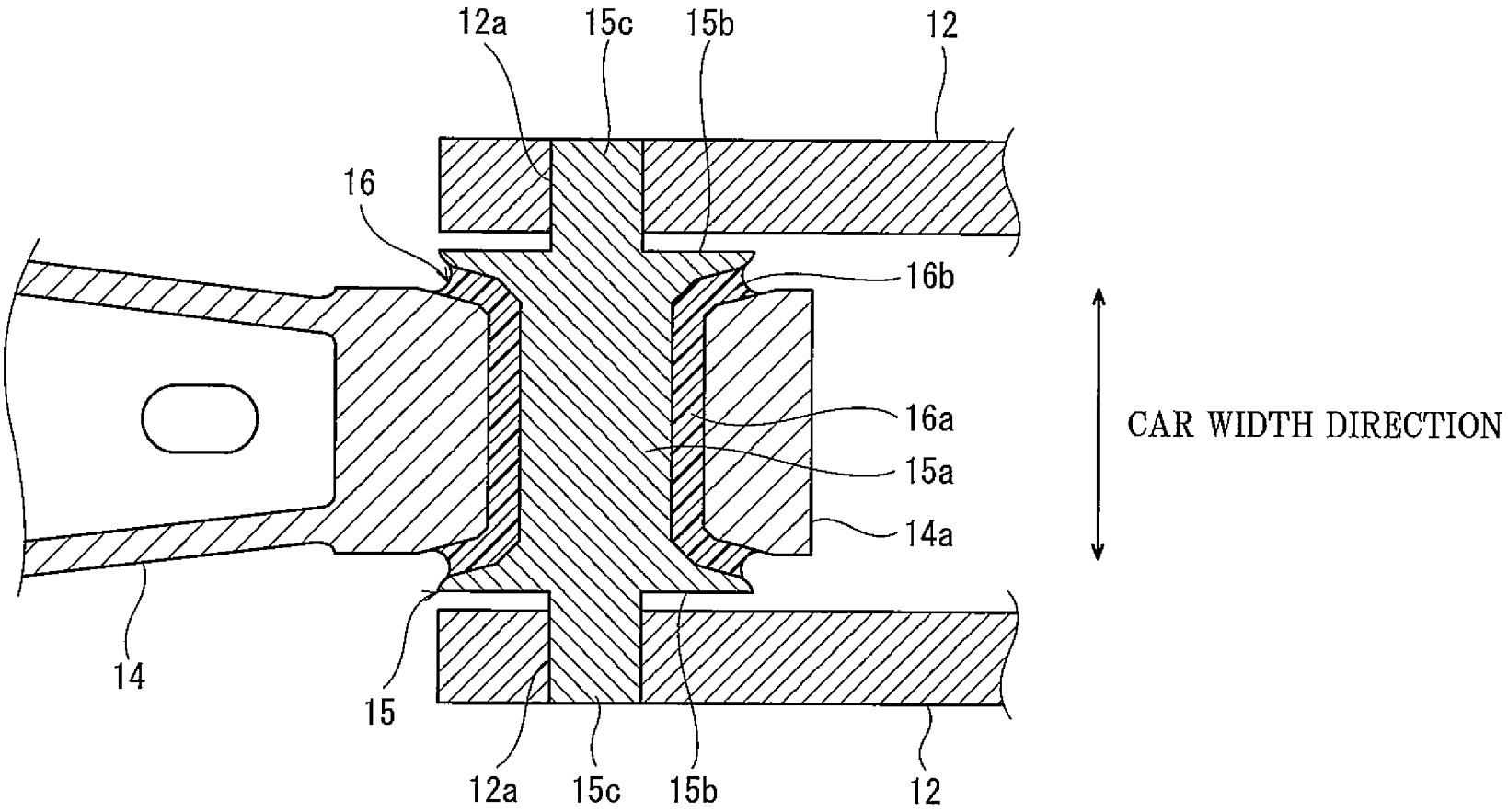
FIG. 2 is a sectional view taken along line II-II of the bogie shown in FIG. 1.

FIG. 2 is a sectional view showing a tubular portion 14*a* of one of axle beams 14 of the bogie 1 shown in FIG. 1 and its vicinity when viewed from below. As shown in FIGS. 1 and 2, the axle box suspension 8 includes the axle box 9, the axle beam 14, a core rod 15, and an elastic bushing 16. To be specific, the bogie 1 is a so-called axle beam bogie. FIG. 2 shows one of connection portions between the axle beams 14 and the receiving seats 12 provided at both end portions of the bogie 1 in the car width direction.

The axle beam 14 extends in the car longitudinal direction from the axle box 9 toward a bogie middle side. The tubular portion 14*a* that is open toward both sides in the car width direction is provided at a tip end of the axle beam 14. The tubular portion 14*a* is formed by fixing, with bolts, a separate semi-tubular portion to a semi-tubular portion formed integrally with the tip end of the axle beam 14. The core rod 15 is inserted into an internal space of the tubular portion 14*a* in the car width direction. The core rod 15 includes a columnar portion 15*a*, a pair of conical flange portions 15*b*, and projection-shaped end portions 15*c*. The pair of flange portions 15*b* are provided at both sides of the columnar portion 15*a* in the car width direction. The end portions 15*c* project outward in the car width direction from both side surfaces of the pair of flange portions 15*b*.

A tubular elastic bushing 16 (rubber bushing, for example) is interposed between the core rod 15 and the tubular portion 14*a*. The elastic bushing 16 includes a cylindrical portion 16*a* and a pair of flange portions 16*b* and is externally fitted to the core rod 15. The pair of flange portions 16*b* project outward in a radial direction from both car width direction sides of the cylindrical portion 16*a*. The end portions 15*c* of the core rod 15 project in the car width direction beyond the tubular portion 14*a* of the axle beam 14.

In the present embodiment, the receiving seats 12 include groove portions 12*a* that are open downward. The groove portions 12*a* are fitted to the end portions 15*c* of the core rod 15 from above. In this state, lid members (pressing members) 20 are fixed to the receiving seats 12 from below with bolts (fasteners) 21 so as to close lower openings of the groove portions 12*a*. Thus, the core rod 15 is sandwiched by the receiving seats 12 and the lid members 20. In the present embodiment, the lid members 20 are arranged in recesses 12*b*, provided under the groove portions 12*a*, so as to close lower openings of the recesses 12*b*. Thus, the lid members 20 are arranged in the receiving seats 12. As above, the core rod 15 is connected to the bogie frame 4. In the present embodiment, for each axle beam 14, the end portions 15*c* of the core rod 15 are sandwiched by the receiving seats 12 and the lid members 20 at both sides in the car width direction.

Figure 3:
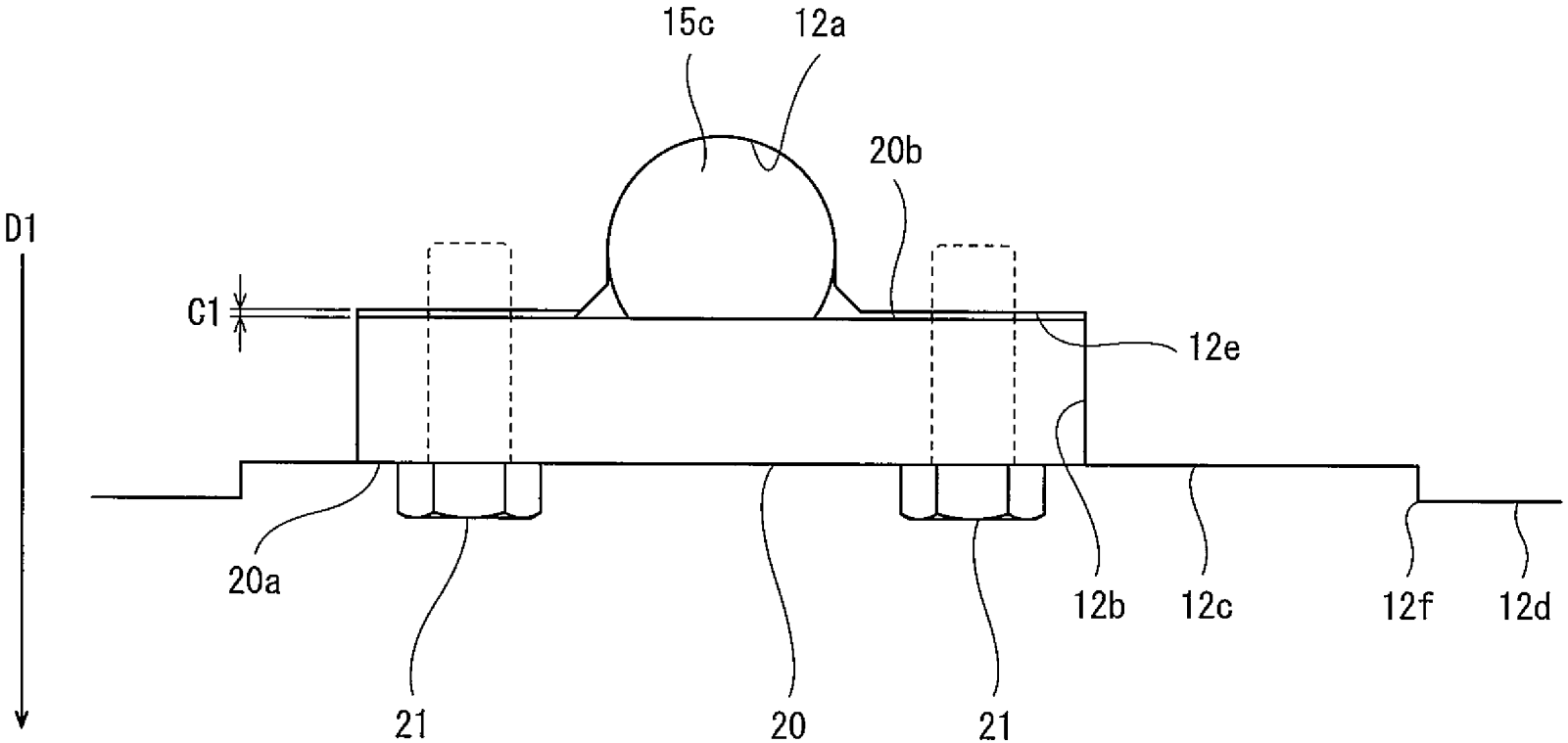
FIG. 3 is an enlarged side view of a fastened portion between a receiving seat and a lid member in the bogie shown in FIG. 1.

FIG. 3 is an enlarged side view showing a portion where the end portion 15*c* of the core rod 15 is sandwiched and supported by the receiving seat 12 and the lid member 20 in the bogie 1 shown in FIG. 1. As shown in FIG. 3, the receiving seat 12 includes the recess (first recess) 12*b* and the groove portion (second recess) 12*a*. The recess 12*b* is concave upward from surfaces 12*c* and 12*d* located at a lower portion of the receiving seat 12. The groove portion 12*a* is provided in the recess 12*b*. To be specific, in the present embodiment, the receiving seat 12 includes the recess 12*b* that is concave upward, and the groove portion 12*a* is formed in the recess 12*b* so as to be concave upward from the recess 12*b*.

A surface (first surface) 12*c* that is a surface extending in a horizontal direction is formed around the recess 12*b* of the receiving seat 12. To be specific, the surface 12*c* is formed at a direction-D1 end portion of the receiving seat 12, the direction-D1 end portion being located around the recess 12*b* of the receiving seat 12, the direction D1 being a car upper-lower direction from the core rod 15 toward the lid member 20 as shown in FIG. 3.

A surface (second surface) 20*a* that is a surface extending in the horizontal direction is formed at a direction-D1 end portion of the lid member 20.

As described above, the end portion 15*c* of the core rod 15 is arranged in the groove portion 12*a*. Moreover, the lid member 20 is arranged in the recess 12*b*. After the end portion 15*c* of the core rod 15 is arranged in the groove portion 12*a*, and the lid member 20 is arranged in the recess 12*b*, the lid member 20 is fastened to the receiving seat 12 with a plurality of bolts 21. In the present embodiment, the lid member 20 is fastened to the receiving seat 12 with two bolts 21.

As shown in FIG. 2, the end portions 15*c* of the core rod 15 project toward both an outside and an inside in the car width direction. At both the outside and the inside in the car width direction, the core rod 15 is pressed by the lid members 20, and the lid members 20 are fastened to the receiving seats 12 with the bolts 21. To be specific, in the present embodiment, for each core rod 15, the lid members 20 are fixed to the receiving seats 12 at two positions that are a contact portion between the core rod 15 and the lid member 20 at the outside in the car width direction and a contact portion between the core rod 15 and the lid member 20 at the inside in the car width direction.

In the present embodiment, a load from the end portion 15*c* of the core rod 15 needs to be surely supported by the lid member 20. Therefore, equal axial forces need to act on the respective bolts 21. However, the axial force cannot be directly measured. Therefore, fastening torques applied to the respective bolts 21 are managed, and whether or not the lid member 20 is horizontally attached to the receiving seat 12 is managed. The former can be managed by fastening work using a torque wrench. The latter is managed by the size of a clearance c1 formed around the groove portion 12*a* of the receiving seat 12 and between a surface 12*e* and a surface 20*b*. The surface 12*e* is formed as a bottom surface of the recess 12*b*, and the surface 20*b* is a surface of the lid member 20 and located close to the core rod 15.

Since not only the fastening torques but also the clearance c1 is managed, it is possible to prevent a case where although the equal fastening torques are applied to the two bolts 21, the lid member 20 is attached to the receiving seat 12 so as to be inclined relative to the receiving seat 12, and this loses appropriate seat surface contact and friction between a bolt head and the lid member 20, and as a result, the equal axial forces do not act.

In the present embodiment, the clearance c1 is managed as below. To be specific, when the position of the surface 20*a* of the lid member 20 in the direction D1 and the position of the surface 12*c* of the receiving seat 12 in the direction D1 are the same as each other, it is determined that the lid member 20 is horizontally attached to the receiving seat 12 without being inclined relative to the receiving seat 12. In contrast, when the position of the surface 20*a* of the lid member 20 in the direction D1 and the position of the surface 12*c* of the receiving seat 12 in the direction D1 are not the same as each other, i.e., deviate from each other, it is determined that the lid member 20 is fastened to the receiving seat 12 so as to be inclined relative to the receiving seat 12. Therefore, it is unnecessary to measure the clearance c1 itself with a clearance gauge or the like, and whether or not the lid member 20 is horizontally attached to the receiving seat 12 can be confirmed only by confirming whether or not the position of the surface 20*a* of the lid member 20 in the direction D1 and the position of the surface 12*c* of the receiving seat 12 in the direction D1 are the same as each other.

Whether or not the position of the surface 20*a* of the lid member 20 in the direction D1 and the position of the surface 12*c* of the receiving seat 12 in the direction D1 are the same as each other may be confirmed by measurement using a depth gauge or the like, visual observation, or touch with a hand.

Figure 4:
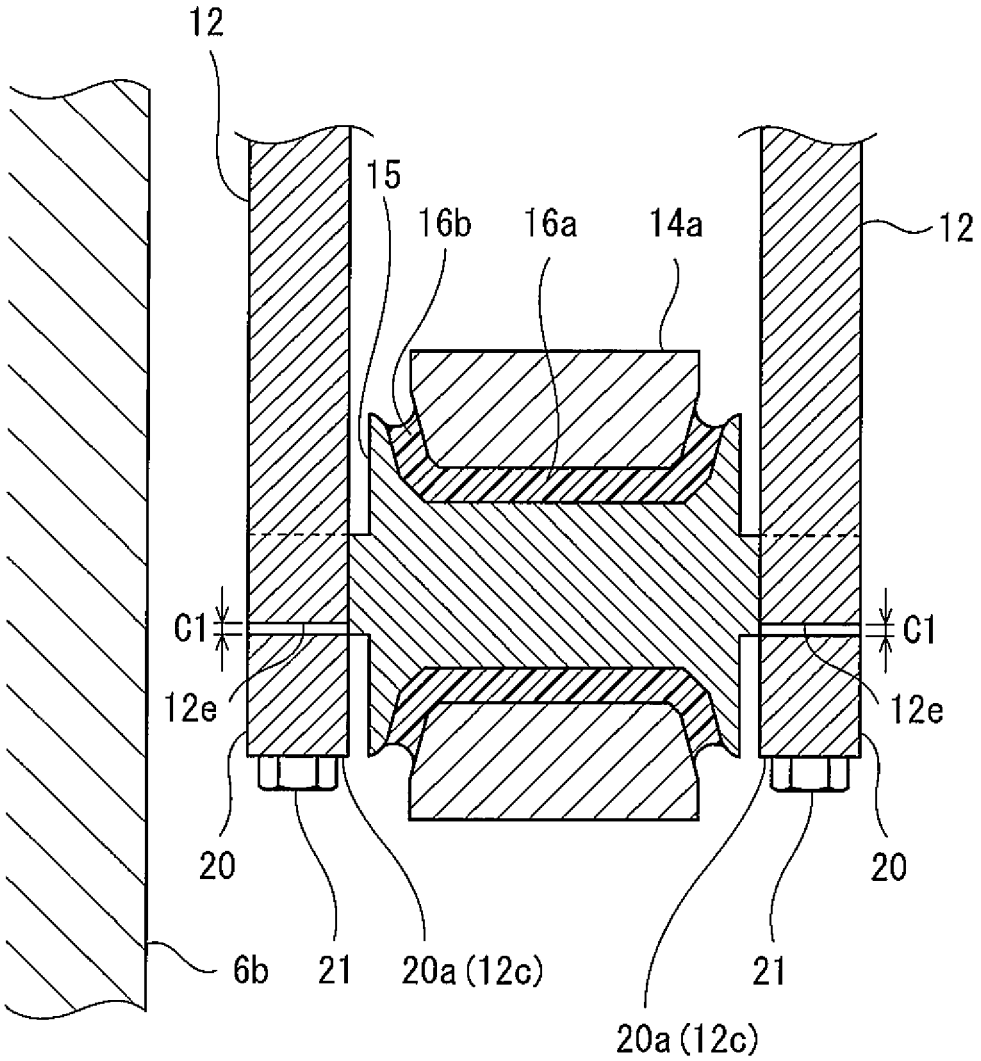
FIG. 4 is a sectional view taken along line IV-IV of the bogie shown in FIG. 1.

FIG. 4 shows a sectional view taken along line IV-IV of the bogie 1 shown in FIG. 1. As shown in FIG. 4, the core rod 15 is supported by the lid members 20 at both end portions thereof in the car width direction. The lid members 20 at both end portions in the car width direction are fastened to the receiving seats 12 with the bolts 21. Since the wheel 6*b* becomes an obstacle for one of the pair of lid members 20, it is difficult to directly see the vicinity of the one lid member 20, and workspace is narrow. Therefore, it is difficult for a worker to continuously take the same posture. In the present embodiment, in order to confirm whether or not the lid member 20 sandwiching the core rod 15 is horizontally fastened to the receiving seat 12 with the bolts 21, whether or not the surface 20*a* of the lid member 20 and the surface 12*c* of the receiving seat 12 are flush with each other is only required to be confirmed by seeing or touching with a hand the surface 20*a* of the lid member 20 and the surface 12*c* of the receiving seat 12. Therefore, such confirmation can be performed easily and can be performed while the worker is taking easy posture. Thus, a burden on the worker can be reduced.

Conventionally, in order to confirm whether or not the lid members 20 are horizontally attached to the receiving seats 12, the clearance c1 between the surface 12*e* of the receiving seat 12 and the surface 20*b*, located close to the core rod 15, of the lid member 20 needs to be measured at each of both sides of the core rod 15 in the car width direction. However, the clearance c1 needs to be measured with a clearance gauge or the like, and it is difficult to directly see the clearance c1 due to the wheel 6*b* as an obstacle. In addition, the workspace is narrow. Therefore, the worker may be forced to work for a long period of time. According to the present embodiment, the confirmation is performed by visual observation from under the bogie or by touch with a hand from under the bogie. Thus, the burden on the worker can be reduced.

In the present embodiment, when a positional difference in the direction D1 between the surface 12*c* of the direction-D1 end portion located around the recess 12*b* of the receiving seat 12 and the surface 20*a* of the direction-D1 end portion of the lid member 20 is 0.5 mm or less, it is determined that the surface 12*c* of the receiving seat 12 and the surface 20*a* of the lid member 20 are the same in position as each other, i.e., are flush with each other. It should be noted that the positional difference in the direction D1 between the surface 12*c* of the receiving seat 12 and the surface 20*a* of the lid member 20 when it is determined that the surface 12*c* of the receiving seat 12 and the surface 20*a* of the lid member 20 are the same in position as each other does not have to be 0.5 mm or less. The positional difference in the direction D1 between the surface 12*c* of the receiving seat 12 and the surface 20*a* of the lid member 20 when it is determined that the surface 12*c* of the receiving seat 12 and the surface 20*a* of the lid member 20 are the same in position as each other may be set in accordance with conditions set when fastening the lid member 20 to the receiving seat 12.

The surface 12*c* located around the recess 12*b* of the receiving seat 12 is required to have positional accuracy. Therefore, in the present embodiment, the surface 12*c* is formed by cutting of machine work. On this account, among outermost surfaces of the receiving seat 12 in the direction D1, the surface 12*c* located around the recess 12*b* is formed so as to be concave upward from the surface 12*d*. It should be noted that a positional relation between the surface 12*c* and the surface 12*d* is not limited to this. For example, when the surface 12*c* is formed by subjecting a projecting portion of a material, which is convex downward, to machine work, the surface 12*c* is located lower than the surface 12*d*. As above, the surface 12*c* of the direction-D1 end portion located around the recess 12*b* of the receiving seat 12 is a machined surface formed by cutting, and the machined surface and the surface 12*d* of the direction-D1 end portion located around the machined surface are different in position in the direction D1 from each other.

In the present embodiment, a step portion 12*f* is formed between the surface 12*c* of the direction-D1 end portion located around the recess 12*b* and the surface 12*d* located around the surface 12*c*. With this, the surface 12*c* and the surface 12*d* are formed so as to be different in position in the direction D1 from each other. Especially, in the present embodiment, since the surface 12*c* located around the recess 12*b* is formed by cutting of machine work, the surface 12*c* is concave upward, and this forms the step portion 12*f*.

Moreover, in the present embodiment, the surface 12*c* and the surface 12*d* are subjected to painting for rust prevention or the like. Therefore, the position of the direction-D1 end portion of the receiving seat 12 and the position of the direction-D1 end portion of the lid member 20 are compared with each other after the painting.

In the present embodiment, the core rod 15 is pressed by the lid members 20 at both the outside and the inside in the car width direction, and the receiving seats 12 and the lid members 20 are fastened to each other with the bolts 21, i.e., the receiving seat 12 and the lid member 20 are fastened to each other at each of two positions that at the outside and the inside in the car width direction. Therefore, as shown in FIG. 2, for each core rod 15, the fastening is performed at two positions in the car width direction. However, the above embodiment is not limited to this. For each core rod 15, the lid member 20 may be fastened to the receiving seat 12 at only one position in the car width direction. Since a fastened portion between the receiving seat 12 and the lid member 20 at the inside in the car width direction is located close to the wheel 6*b*, work for the fastened portion at the inside in the car width direction is more difficult for the worker than work for the fastened portion at the outside in the car width direction. Therefore, when the fastening is performed at only one position in the car width direction, it is preferable to perform the fastening at the inside in the car width direction.

The above embodiment has described a case where the core rod 15 is located at an upper side, and the lid members 20 support the core rod 15 from below. However, the above embodiment is not limited to this. The positional relation between the core rod 15 and the lid member 20 may be reversed. To be specific, the above embodiment may be configured such that: recesses are formed at the receiving seats 12 so as to be concave downward; groove portions are formed in the recesses so as to be concave further downward; a core rod is provided at the groove portions; and lid members press the core rod from above in the recesses. According to this configuration, the bolts are fastened from an upper side toward a lower side. Therefore, workload of the worker is reduced. In this case, most of the load from the core rod 15 is supported by the receiving seat 12, and pressing force of the lid member 20 that presses the core rod 15 downward can be made uniform in the car longitudinal direction. Therefore, the pressing force applied to the core rod 15 by the lid member 20 does not locally concentrate, and the core rod 15 can be stably arranged in the recess.

The above embodiment has described a case where one bolt 21 is provided at each of both sides of the core rod 15 in the car longitudinal direction, and two bolts 21 are provided in the car longitudinal direction. However, the above embodiment is not limited to this. Two bolts 21 may be provided at each of both sides of the core rod 15 in the car longitudinal direction, i.e., four bolts 21 may be provided in the car longitudinal direction. Moreover, the number of bolts may be larger than the above. The number of bolts at one side of the core rod 15 in the car longitudinal direction and the number of bolts at the other side of the core rod 15 in the car longitudinal direction do not have to be equal to each other and may be different from each other.

The positions of parts of the surface 20*a* of the end portion of the lid member 20 which parts sandwiches the core rod 15 do not have to be the same in the direction D1 as each other as a whole. A surface of one of end portions of the lid member 20 which portions sandwich the core rod 15 in the car longitudinal direction and a surface of the other end portion of the lid member 20 may be different in position in the direction D1 from each other. The surface of the direction-D1 end portion of the lid member 20 and the surface of the corresponding direction-D1 end portion of the receiving seat 12 are only required to be flush with each other in the car upper-lower direction.

Figure 5:
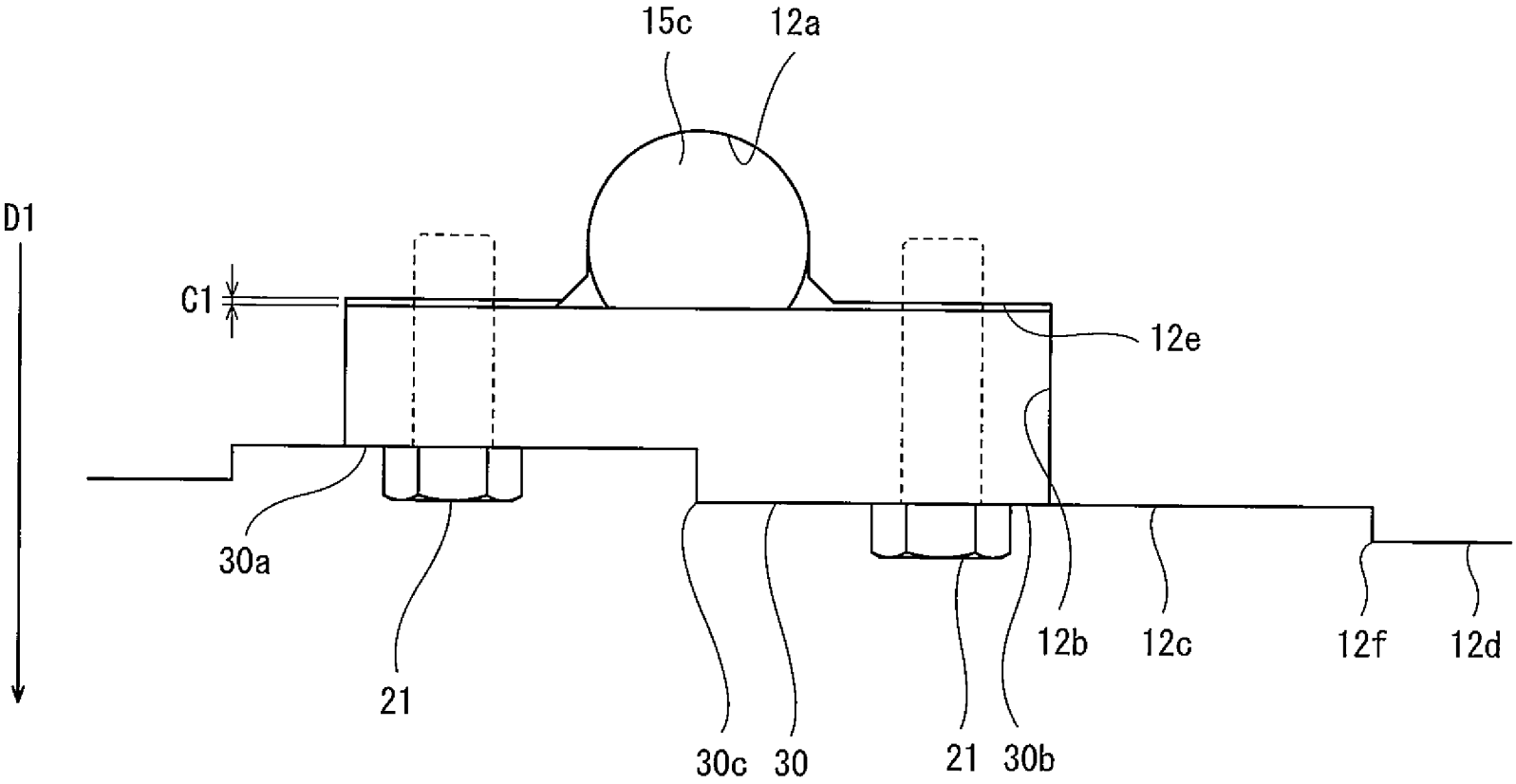
FIG. 5 is an enlarged side view showing the fastened portion between the receiving seat and the lid member in the bogie according to another embodiment.

FIG. 5 is a side view showing the fastened portion between the receiving seat and the lid member when one of parts of the surface of the direction-D1 end portion of the lid member which parts sandwich the core rod in the car longitudinal direction and the other part of the surface of the direction-D1 end portion of the lid member are different in position in the direction D1 from each other.

In a lid member 30 shown in FIG. 5, one of direction-D1 end portions of the lid member 30 which portions sandwich the end portion 15*c* of the core rod 15 and the other direction-D1 end portion of the lid member 30 are different in position in the direction D1 from each other. To be specific, a surface 30*a* of the lid member 30 and a surface 30*b* of the lid member 30 sandwich the end portion 15*c* of the core rod 15 and are different in position in the direction D1 from each other. Therefore, a step portion 30*c* is formed at the lid member 30.

In the lid member 30, even when one of the direction-D1 end portions of the lid member 30 which portions sandwich the end portion 15*c* of the core rod 15 and the other direction-D1 end portion of the lid member 30 are different in position in the direction D1 from each other, the direction-D1 end portion of the lid member 30 and the corresponding direction-D1 end portion of the receiving seat 12 become the same in position in the direction D1 as each other as long as the lid member 30 is horizontally fastened to the receiving seat 12. Therefore, even when one of the direction-D1 end portions of the lid member 30 which portions sandwich the end portion 15*c* of the core rod 15 and the other direction-D1 end portion of the lid member 30 are different in position in the direction D1 from each other, it is only required to confirm whether or not the surface of the end portion of the lid member 30 and the surface of the corresponding end portion of the receiving seat 12 are the same in position in the direction D1 from each other.

The present invention is not limited to the above embodiment. Modifications, additions, and eliminations may be made with respect to the configuration of the present invention. For example, the bogie 1 is a bolster-equipped bogie but may be a bolsterless bogie. Moreover, the bogie 1 is a plate spring bogie including the plate springs 10 but is not limited to the plate spring bogie. The present invention is applicable to general bogies.

REFERENCE SIGNS LIST

12 receiving seat
12*a* groove portion (second recess)
12*b* recess (first recess)
12*c* surface (first surface)
15 core rod
20, 30 lid member (pressing member)
20*a* surface (second surface)
21 bolt (fastener)

The invention claimed is:

1. A support structure of a railcar bogie, the support structure comprising:

a receiving seat of a bogie frame, the receiving seat including a first recess and a second recess provided in the first recess;

a core rod arranged in the second recess;

a pressing member arranged in the first recess configured to press the core rod against the receiving seat; and a plurality of fasteners configured to fasten the pressing member to the receiving seat to sandwich the core rod by the pressing member and the receiving seat, wherein:

the fasteners fasten the pressing member and the receiving seat such that a clearance is formed between the pressing member and the receiving seat;

a car upper-lower direction end portion, located around the first recess, of the receiving seat and a car upper-lower direction end portion of the pressing member are flush with each other;

the car upper-lower direction end portion, located around the first recess, of the receiving seat is a machined surface that is formed by cutting and is required to have positional accuracy; and the machined surface and a car upper-lower direction end portion, located around the machined surface, of the receiving seat are different in position in a car upper-lower direction from each other to form a step portion.

2. The support structure according to claim 1, wherein:

a first surface is formed at the car upper-lower direction end portion, located around the first recess, of the receiving seat;

a second surface is formed at the car upper-lower direction end portion of the pressing member; and the first surface and the second surface are substantially flush with each other.

3. A method of supporting a railcar bogie, the method comprising:

arranging a core rod in a second recess of a receiving seat including a first recess and the second recess, the second recess being provided in the first recess;

arranging a pressing member in the first recess, wherein a car upper-lower direction end portion, located around the first recess, of the receiving seat is a machined surface that is formed by cutting and is required to have positional accuracy, and the machined surface and a car upper-lower direction end portion, located around the machined surface, of the receiving seat are different in position in a car upper-lower direction from each other to form a step portion; and fastening the pressing member to the receiving seat with a plurality of fasteners such that a clearance is formed between the pressing member and the receiving seat, to support the core rod between the receiving seat and the pressing member, wherein the pressing member and the receiving seat are fastened to each other with the fasteners such that the car upper-lower direction end portion, located around the first recess, of the receiving seat and a car upper-lower direction end portion of the pressing member are substantially flush with each other.

* * * * *